US005480514A

United States Patent [19]

Suzuki

[11] Patent Number: 5,480,514

[45] Date of Patent: Jan. 2, 1996

[54] DIAPHRAGM OF ELECTROACOUSTIC TRANSDUCER AND METHOD OF MANUFACTURING THEREOF

[75] Inventor: Akihisa Suzuki, Higashihiroshima, Japan

[73] Assignee: Sharp Kabushiki Kaisha, Osaka, Japan

[21] Appl. No.: 101,034

[22] Filed: Aug. 3, 1993

[30] Foreign Application Priority Data

Aug. 4, 1992 [JP] Japan ..... 4-208070

[51] Int. Cl.[6] ..... D21J 3/12

[52] U.S. Cl. ..... 162/231; 162/149; 162/141; 162/218

[58] Field of Search ..... 181/169; 162/149, 162/141, 218, 231, 382, 223; 264/86, 87

[56] References Cited

U.S. PATENT DOCUMENTS 1,717,775 6/1929 Hawley ..... 162/219
3,935,924 2/1976 Nagao et al. ..... 162/141

FOREIGN PATENT DOCUMENTS 0037738 6/1978 Japan ..... 181/169
4368098 12/1992 Japan .

OTHER PUBLICATIONS

"Radio Technology", Aug., 1983 Kunio IMAI.
Rydholm, Sven A., Pulping Process, Interscience Publishers, New York (1965) pp. 51–54.
Dinwoodie, J. M., The Influence of Anatomical and Chemical Characteristics of Softwood Fibers On The Properties of Sulfate Pulp, TAPPI, vol. 49, No. 2 (1966) pp. 57–67.
Pulp and Paper, Chemistry and Chemical Technology, Third Edition, vol. 1, James P. Casey, Wiley—Interscience Publication (New York) 1980 pp. 146–147.

*Primary Examiner*—Brenda Adele Lamb
*Attorney, Agent, or Firm*—Birch, Stewart, Kolasch & Birch

[57] ABSTRACT

The diaphragm of the electroacoustic transducer is made of a material in which fibers having at least two different radii taken out of wood are mixed together. Two mean radii A and B, among different mean radii of the fibers are set to satisfy the relationship: $0.5 \times A \leqq B \leqq 0.5 \times A$. By utilizing such a diaphragm, the balance of the density, rigidity, and internal loss of the diaphragm can be improved, and thus the acoustic characteristics of the electroacoustic transducer such as a speaker unit can be improved.

12 Claims, 2 Drawing Sheets

DIAPHRAGM OF ELECTROACOUSTIC TRANSDUCER AND METHOD OF MANUFACTURING THEREOF

BACKGROUND OF THE INVENTION

1. Field of the Invention

The present invention relates to a diaphragm of an electroacoustic transducer and a method of manufacturing thereof, and more particularly, to materials for a diaphragm of a speaker having superior characteristics with highly balanced internal loss, density and rigidity, and a method of manufacturing the diaphragm.

Conventionally, many materials have been developed for the diaphragm of the speaker in order to improve acoustic characteristics of the speaker. The diaphragm of the speaker having ideal characteristics requires low density, high rigidity, large internal loss and the like. Therefore, materials which includes a high rigidity substance such as carbon fiber and aramid fiber, or materials having a large internal loss such as polypropylene have been utilized.

In manufacturing the diaphragm, however, if the rigidity increases, the internal loss tends to be reduced, while the rigidity and the density tend to be reduced if the internal loss increases. Thus, an important object of manufacturing the diaphragm is to set the above three factors, i.e., the density, the rigidity and the internal loss of materials of the diaphragm to the best balanced state.

The characteristics of the materials of the diaphragm of the speaker which have been utilized conventionally are described, for example, in *Radio Technology,* August, 1983, pp. 77. More particularly, as for the diaphragm made of an aluminum alloy, for example, its density is 2.7 g/cm$^3$, Young's modulus is $62\times10^{10}$ dyne/cm$^2$, and its internal loss is about 0.002. As for the diaphragm made of polypropylene, its density is 0.91 g/cm$^3$, Young's modulus is $1.08\times10^{10}$ dyne/cm$^2$, and its internal loss is 0.07. Meanwhile, as for the diaphragm for a general speaker made of wood pulp, its density is 0.55 g/cm$^3$, Young's modulus is $1.32\times10^{10}$ dyne/cm$^2$, and internal loss is about 0.05.

As described above, the diaphragm made of wood pulp has an appropriately large internal loss and a low density compared with the diaphragm made of an aluminum alloy: however, it has a disadvantage of narrower frequency band due to an insufficient rigidity.

SUMMARY OF THE INVENTION

An object of the present invention is to provide a diaphragm of an electroacoustic transducer which has improved acoustic characteristics and is made of wood pulp by implementing an appropriately balanced state of density, rigidity and internal loss of a material.

The diaphragm of the electroacoustic transducer of the present invention is made of a material which includes fibers taken out of wood having at least two kinds of different mean radii.

Among two or more different mean radii of the above fibers, at least two different mean radii A, B preferably satisfy the following inequality:

$$0.05\times A \leqq B \leqq 0.5\times A$$

Since the fibers constituting the diaphragm have mean radii satisfying the above relationship, thin fibers will get into spaces where thick fibers are entangled with each other. Therefore, the rigidity and the internal loss can be enlarged without increasing the density. As a result, the density, rigidity and internal loss of the diaphragm will be highly balanced, and accordingly the acoustic characteristics of the electroacoustic transducer can be improved.

Each of the fibers having different mean radii included in the diaphragm of the electroacoustic transducer according to the present invention may be the fibers taken out of wood of the same kind, or may be the fibers taken out of woods of different kinds.

As an example of the fibers having different mean radii, a mixture of a fiber having a mean radius of about 10 μm and a fiber having a mean radius of about 1 μm having approximately the same weight ratio is used.

The present invention includes the electroacoustic transducer which applies the diaphragm made of the above material.

A method of manufacturing the diaphragm of the electroacoustic transducer according to the present invention includes the steps of forming a material which includes the fibers having at least two different mean radii and taken out of wood, forming paper by using said set material, and molding the paper into a cone shape.

At least two different radii A, B of the fibers forming the above material preferably satisfy the following inequality:

$$0.05\times A \leqq B < 0.5\times A$$

In a preferable embodiment, the step of forming the above material includes the step of mixing a first fiber having a predetermined radius of a predetermined wood and a second fiber having a radius thinner than the first fiber obtained by shearing the fiber texture of the same kind as the first fiber by a mechanical external force.

Through such a step, the diaphragm of the electroacoustic transducer having desired characteristics can be obtained by utilizing the fibers taken out of one kind of wood.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
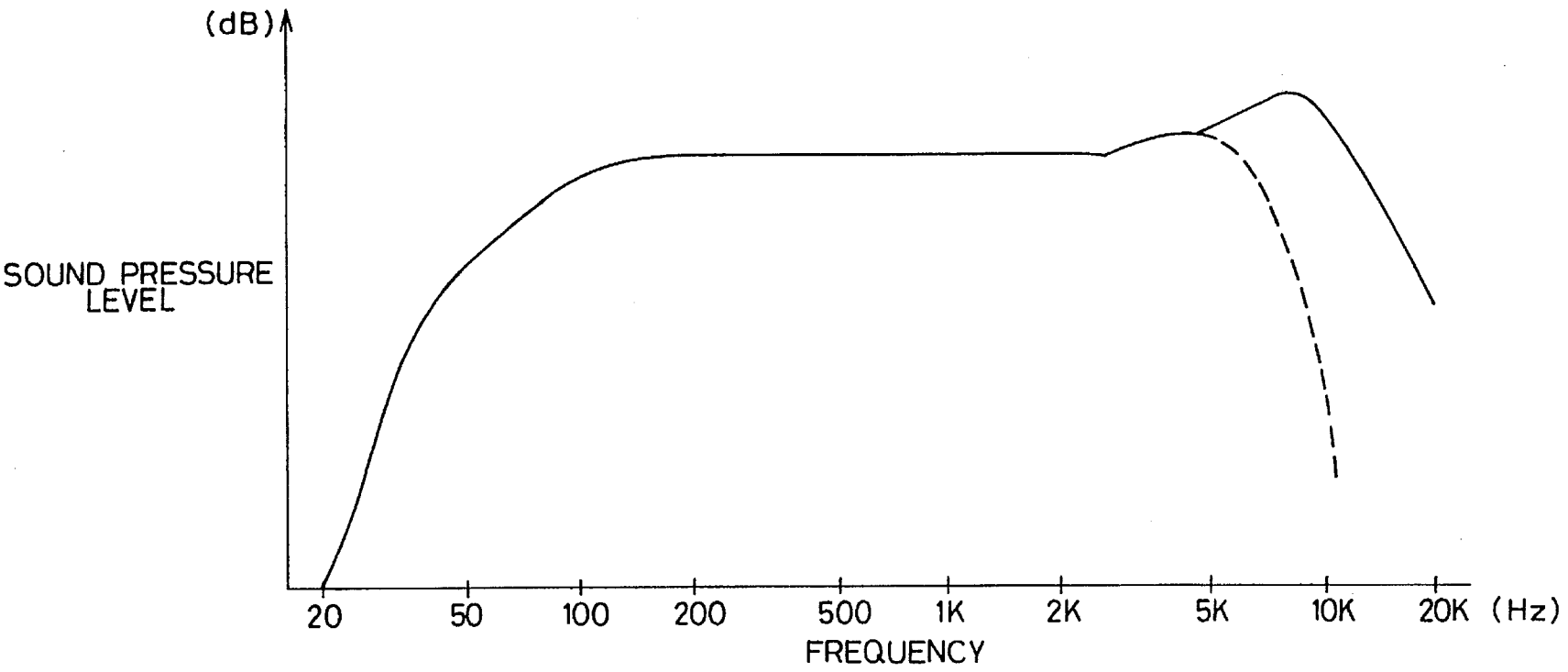
FIG. 1 is a graph showing the characteristics of the frequency-to-sound pressure level between a speaker unit according to one embodiment of the present invention and a conventional speaker unit having a diaphragm made of wood pulp.

One embodiment of the present invention will be described based on FIGS. 1 and 2.

Figure 2:
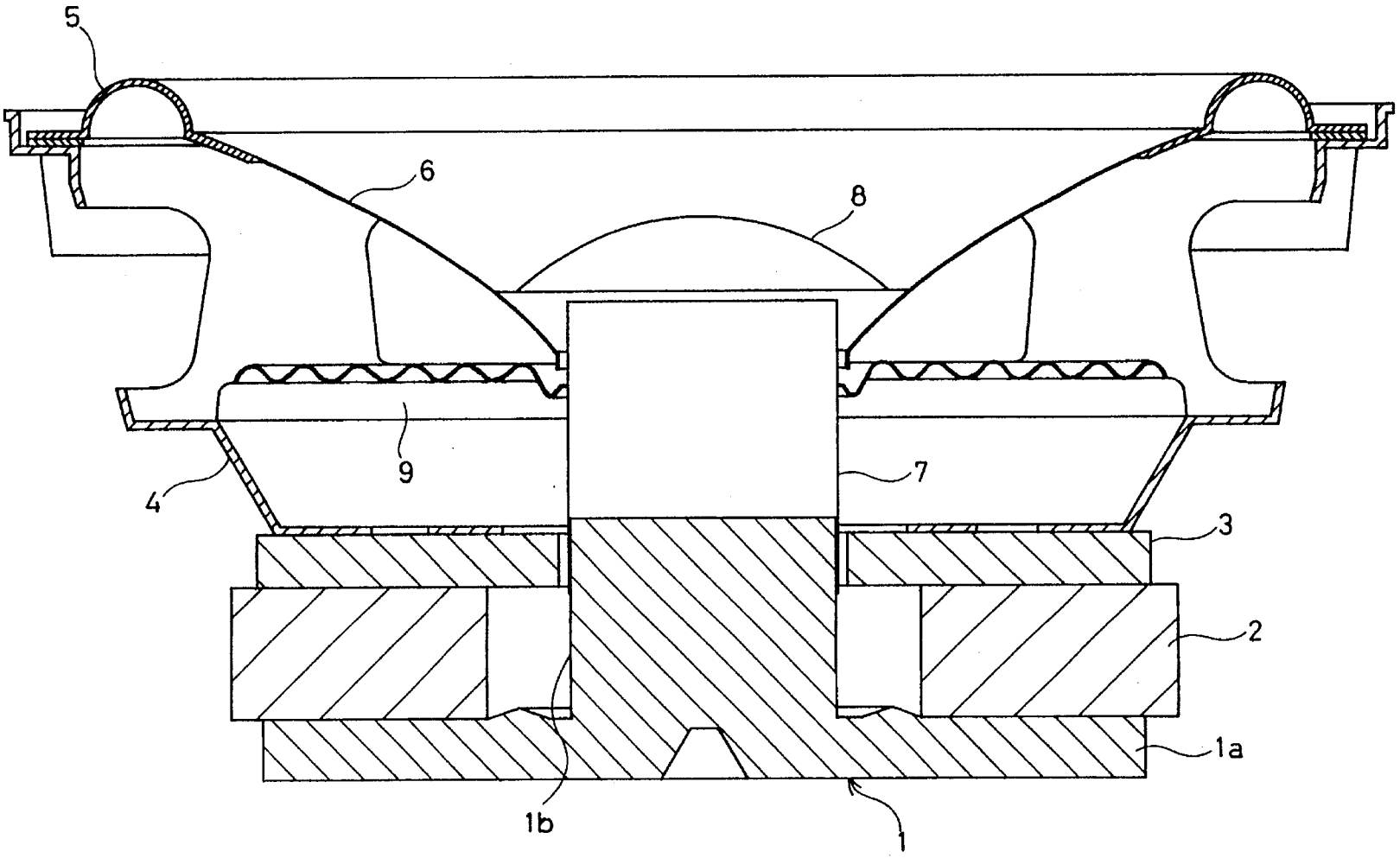
FIG. 2 is a sectional view showing a structure common in the speaker unit according to one embodiment of the present invention and the conventional speaker unit, of which characteristics are shown in FIG. 1.

Referring to FIG. 2, a speaker unit according to one embodiment of the present invention includes a support plate 1, a magnet 2, an upper plate 3, a frame 4, an edge 5, a diaphragm 6, a voice coil 7, a center cap 8 and a damper 9.

Support plate 1 has a circular plane portion 1*a*, in the center of which center pole 1*b* is provided. Magnet 2 is secured at an end on the side of center pole 1*b* of plane portion 1*a*, and upper plate 3 is secured on this magnet 2. Support plate 1, magnet 2 and upper plate 3 constitute a magnetic circuit, and a clearance between center pole 1*b* and upper plate 3 functions as a magnetic gap.

Frame 4 is secured on upper plate 3, and edge 5 made of resilient material is adhered to the periphery of the upper end of frame 4. Diaphragm 6 is adhered at the upper end of edge 5. The cylindrical voice coil 7 is adhered to the lower end of diaphragm 6 and a dustproof center cap 8 is provided slightly above the voice coil 7.

The lower end of voice coil 7 is inserted into a magnetic gap, while damper 9 which is formed like a wall is adhered to its inner peripheral end. Damper 9 is secured to frame 4 at its outer peripheral end for supporting voice coil 7 resiliently to frame 4.

The speaker unit of the present invention having the above structure oscillates diaphragm 6 in the direction of a shaft of center pole 1*b* by driving voice coil 7 with an electromagnetic force generated in the magnetic circuit.

Diaphragm 6 of the speaker unit according to the present invention is formed by the fibers having a plurality of thicknesses and taken out of one kind of wood. As for the thickness of the fibers, mean radii A, B of the fibers of at least two different thicknesses are set to satisfy the following relationship:

$$0.05\times A \leqq B \leqq 0.5\times A$$

Such fibers can be formed, for example, by mixing a thick fiber having a predetermined radius and a thin fiber which is obtained by shearing the fiber texture of the fiber of the same kind over a long time by a mechanical external force such as beating. Ends of the fibers which are sufficiently beaten have such a characteristic that fibers can easily be entangled with each other as the fibers are torn into small strips. In order to utilize such a characteristic effectively, it is desired to use those fibers that satisfy the above inequality. Also, by making radii of the fibers different, such a structure can be obtained in which thin fibers enter into spaces where thick fibers are entangled with each other, and accordingly, the ridigity and the internal loss of diaphragm 6 can be increased with the density kept low.

In the present embodiment, a mean radius of thick fibers is 10 μm, and a mean radius of thin fibers is about 1 μm. It is because, generally, most of the wood pulp include the fibers having a mean radius of about 10 μm.

If those fibers having such mean radii are mixed with 50% each by weight to produce paper, and diaphragm 6 is formed of that paper, the material characteristics of that diaphragm would be a density of 0.595 g/cm$^3$, Young's modulus of $3.36\times10^{10}$ dyne/cm$^2$, and internal loss of 0.22, and thus its acoustic characteristics as a speaker is improved. As a result, as shown in FIG. 1, the frequency characteristics of the speaker unit can be improved in a high frequency band as shown by a solid line compared with the speaker unit utilizing the conventional diaphragm as shown by a dotted line.

In the present embodiment, diaphragm 6 made of one kind of wood pulp has been described: however, the material in which different kinds of wood pulp are mixed together may be utilized. Also, a mixture ratio of the wood pulp is not limited to the example described above.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A diaphragm for an electroacoustic transducer, comprising:

a material including wood fibers having at least two different mean radii at an approximately equal weight ratio, one of said fibers having a mean radius of about 10 μm and a second of said fibers having a mean radius of about 1 μm.

2. The diaphragm for an electroacoustic transducer according to claim 1, wherein said fibers satisfy the following inequality:

$(0.05\times A)\leqq B\leqq 10.5\times A)$, where A=the mean radius of said one of said fibers, and B=the mean radius of said second of said fibers.

3. The diaphragm for an electroacoustic transducer according to claim 1, wherein said one of said fibers and said second of said fibers are taken out of wood of the same kind.

4. The diaphragm for an electroacoustic transducer according to claim 1, wherein said one of said fibers is formed of a first kind of wood and said second of said fibers is formed of a second different kind of wood.

5. An electroacoustic transducer, comprising:

a diaphragm made of a material including wood fibers having at least two different radii at an approximately equal weight ratio, one of said fibers having a mean radius of about 10 μm and a second of said fibers having a mean radius of about 1 μm.

6. The electroacoustic transducer according to claim 5, wherein said fibers satisfy the following inequality:

$(0.05\times A)\leqq B\leqq 10.05\times A)$, where A=the mean radius of said one of said fibers, and B=the mean radius of said second of said fibers.

7. The electroacoustic transducer according to claim 5, wherein said one of said fibers and said second of said fibers are taken out of wood of the same kind.

8. The electroacoustic transducer according to claim 5, wherein said one of said fibers is formed of a first kind of wood and said second of said fibers is formed of a second different kind of wood.

9. A method of manufacturing a diaphragm of an electroacoustic transducer comprising the steps of:

forming a material including wood fibers having at least two different mean radii at an approximately equal weight ratio, one of said fibers having a mean radius of about 10 μm and a second of said fibers having a mean radius of about 1 μm;

forming paper utilizing said material; and molding said paper into a cone shape.

10. The method of manufacturing a diaphragm of an electroacoustic transducer according to claim 9, wherein said fibers satisfy the following inequality:

$(0.05\times A), \leqq B\leqq (0.5\times A)$, where A=the mean radius of said one of said fibers, and B=the mean radius of said second of said fibers.

11. The method of manufacturing a diaphragm of an electroacoustic transducer according to claim 9, wherein said step of forming the material includes the step of mixing said one of said fibers of a predetermined wood and said second of said fibers obtained by shearing, by a mechanical external force.

12. The method of manufacturing a diaphragm of an electroacoustic transducer according to claim 9, wherein said step of forming the material includes the step of mixing said one of said fibers taken out of a predetermined wood and said second of said fibers taken out of wood of a different kind from said predetermined wood.

* * * * *